US007843392B2

(12) United States Patent
Munger et al.

(10) Patent No.: US 7,843,392 B2
(45) Date of Patent: Nov. 30, 2010

(54) DUAL FREQUENCY ANTENNA SYSTEM

(75) Inventors: Archer David Munger, Mesa, AZ (US); Kevin Duane House, Gilbert, AZ (US); Russell Thomas Thompson, Scottsdale, AZ (US)

(73) Assignee: General Dynamics C4 Systems, Inc., Scottsdale, AZ (US)

( * ) Notice: Subject to any disclaimer, the term of this patent is extended or adjusted under 35 U.S.C. 154(b) by 0 days.

(21) Appl. No.: 12/176,117

(22) Filed: Jul. 18, 2008

(65) Prior Publication Data

US 2010/0013735 A1 Jan. 21, 2010

(51) Int. Cl.
*H01Q 1/36* (2006.01)
*H01Q 1/38* (2006.01)

(52) U.S. Cl. ..... 343/700 MS; 343/895

(58) Field of Classification Search ..... 343/895, 343/700 MS, 846

See application file for complete search history.

(56) References Cited

U.S. PATENT DOCUMENTS 4,014,028 A 3/1977 Cone et al.
4,847,627 A * 7/1989 Knight ..... 343/705
5,581,268 A * 12/1996 Hirshfield ..... 343/853
5,854,608 A * 12/1998 Leisten ..... 343/895
6,011,524 A 1/2000 Jervis
6,212,413 B1 4/2001 Kiesi
6,545,649 B1 4/2003 Seavey
7,113,148 B2 9/2006 Lan et al.

FOREIGN PATENT DOCUMENTS

WO WO98028817 A1 7/1998

* cited by examiner

*Primary Examiner*—Michael C Wimer
(74) *Attorney, Agent, or Firm*—Meschkow & Gresham, P.L.C.

(57) ABSTRACT

A dual-frequency conformal multi-filiar helical antenna system (20) provides a low-profile, low drag antenna useable in flying equipment. This antenna system (20) securely holds within its shell (22) signal distribution circuitry (64), signal combining circuitry (68), and any other circuit components necessary for antenna system (20) to communicate with other stations or devices. Antenna system (20) has radiating conductors (24, 32) tuned to two different frequencies such that simultaneous transmission and reception of signals is possible in the same and opposite directions.

6 Claims, 6 Drawing Sheets

DUAL FREQUENCY ANTENNA SYSTEM

GOVERNMENT RIGHTS

This invention was made with Government support under F08630-03-C-0120 awarded by the Air Force. The Government has certain rights in this invention.

TECHNICAL FIELD OF THE INVENTION

The present invention relates to the field of antenna systems. More specifically, the present invention relates to antenna systems having at least two antennas wrapped around a shell, each antenna operating at a different frequency.

BACKGROUND OF THE INVENTION

Many contemporary devices have been developed to rely not only on earth-orbiting satellites for navigation purposes, but also ground-based stations for inter-device communication. Specialized products have been created to address communication between a flying object and both earth-based stations and earth-orbiting satellites.

Contemporary antennas used on flying equipment typically have a blade design, such that the antenna protrudes off the surface of the equipment with the edge of the blade design facing the direction of travel. This sort of design gives rise to high drag when the equipment is in use, as the protrusion affects the aerodynamic nature of the equipment. Also, this sort of design can cause physical interference with other devices on the flying equipment, as the antenna is an external device placed on the equipment's outer hull. In situations where these antennas are initially housed within the body of the flying equipment, to be later deployed for communication purposes, deployment can cause physical interference with other features of the equipment, as pre-deployment space for the antennas cannot be used for other payloads. Also, additional mechanisms are added to effect the deployment of these antennas. Transmission and reception patterns of such blade antennas have similar gain in axial and transverse directions.

Patch antennas have also been used in flying equipment. Using such antennas has significant effects on the directionality of potential communication. Patch antennas are thin antennas printed close to a ground layer, and occasionally attached to the hull of the flying equipment. These antennas often transmit and receive signals in a direction perpendicular to the surface on which they are attached. As a result, these antennas are often unable to provide their greatest gain in both the aft and forward directions, but rather only in a single direction.

Helical antennas have widespread useage in traditional satellite communication systems. This is partly due to the antenna's ability to produce and receive circularly polarized radiation, the type of radiation often used in such systems. Also, because the radiation pattern of such antennas is nearly hemispherical, they are well suited for such communications.

There are applications where transmitting and receiving signals occur at different frequencies. In such circumstances, it is desirable to have a dual-band antenna. However, often the configurations available in conventional dual-band helical antennas are less than desirable. One example is to place two single-band helical antennas end-to-end so that they form a single cylinder. This addresses the need for dual band; however it significantly increases the length of the antenna.

A major use of dual-band functionality is to accommodate separate transmit and receive frequencies. In many applications, such transmit/receive functions ensure that transmissions are complete before a responding signal is sent by a device. However, due to the coupling between the transmitter and receiver, if the antenna were to transmit and receive signals simultaneously significant interference could occur between the signals, degrading the integrity of the communication. If dual-band functionality is obtained from separate antennas, the antennas traditionally are mounted a distance apart and/or incorporate extra filtering to separate and isolate the transmit and receive signals. It is desirable for a dual-band antenna system, consisting of two antennas mounted in close proximity, to have high isolation between the two systems so that interference between the simultaneous transmit and receive signals do not degrade the integrity of the communication. While separate filters can be used to increase this isolation, they are undesirable because of their size, weight, cost and attenuation of the signal.

Also, due to the physical structure of contemporary helical antennas, these devices, when used with flying equipment, would be placed external to the surface, or associated with a deployment mechanism to ensure that the antenna can transmit and receive signals. These are problematic solutions because a permanent fixture upon the surface of a flying object increases the drag of the object, and a deployment mechanism may interfere with other functions of the device.

Flying equipment is generally restricted to small weight and size limitations, as the larger and heavier an object is, the more costly the equipment is. The transmitting and receiving circuitry associated with any antenna must be housed in some unit along with other component circuitry to facilitate communication. The physical structure of contemporary helical antennas requires an external housing separate from the antennas for such circuitry. This increases the weight and complexity of the flying equipment, as proper shielding and housing must be created to ensure that the components are held safely.

In order to ensure that an antenna can function at the requisite frequency, the antenna must be tuned. The process of tuning an antenna becomes more difficult when multiple antennas operating at different frequencies are brought together into a system. Conventionally, in such systems, tuning any one antenna will affect the tuned frequencies of the other antennas in the system. The complexity of the tuning process increases when the antennas are closely positioned together in the system.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
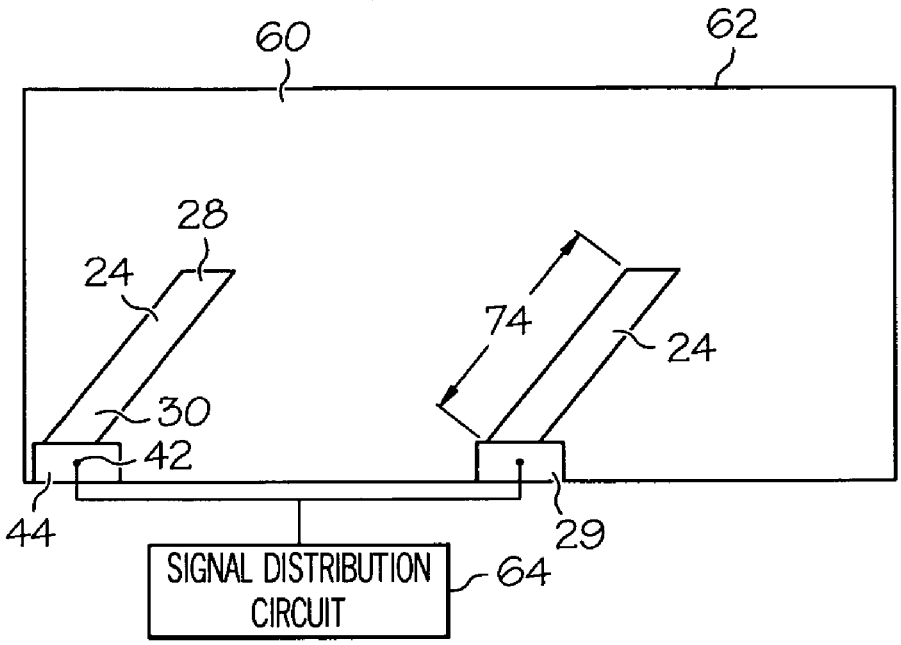
FIG. 1 is a planar representation of one antenna in an antenna system in accordance with a preferred embodiment of the present invention.
Figure 3:
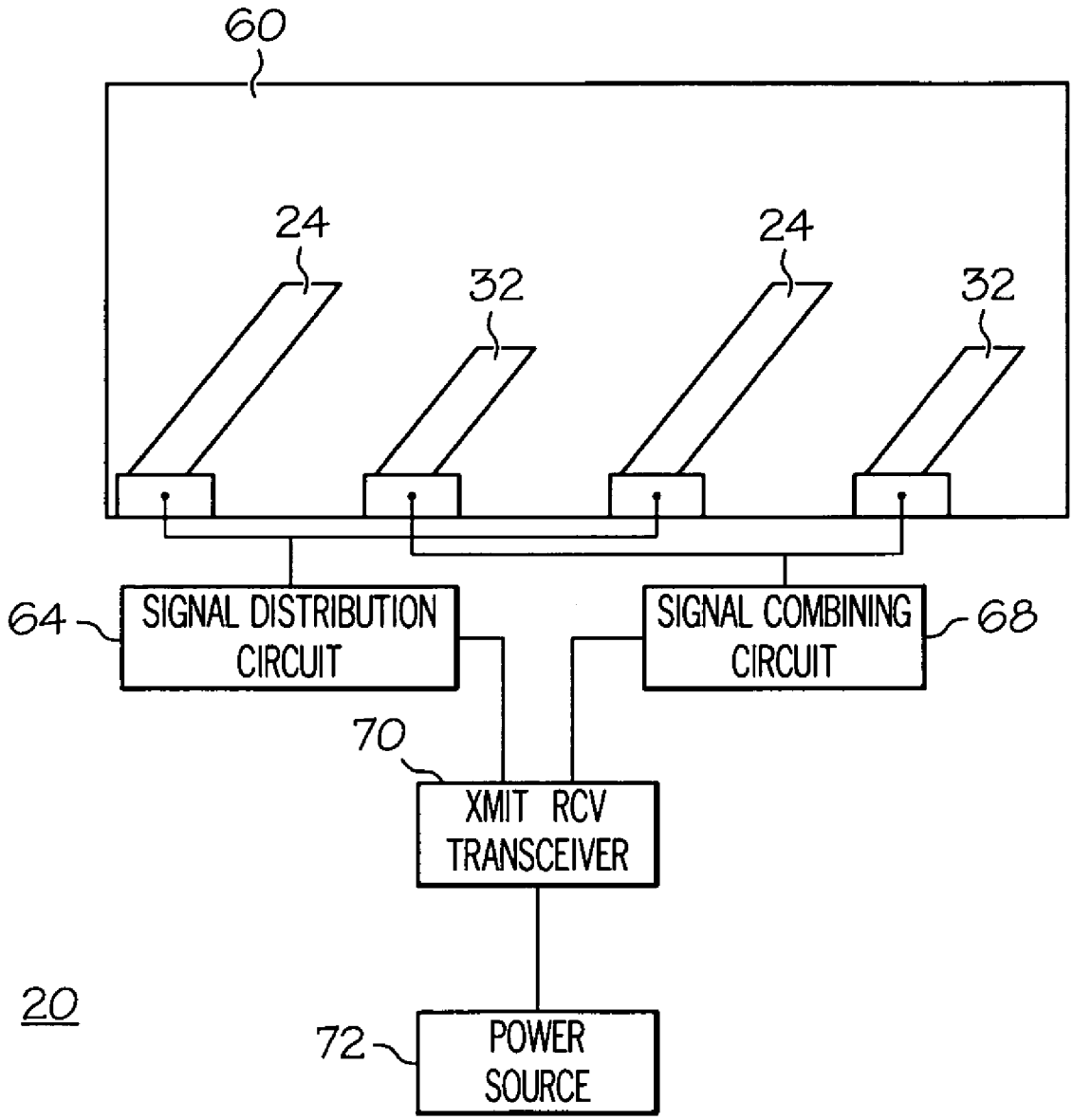
FIG. 3 is a planar representation of an antenna system in accordance with a preferred embodiment of the present invention.

FIG. 1 is a planar representation of one antenna 62 in antenna system 20 (shown in FIG. 3). First antenna 62 includes a set of radiating conductors 24, and a signal distribution circuit 64. Signal distribution circuit 64 can include a power amp, filter network, and/or any other circuitry (not shown) necessary to ensure that first antenna 62 can communicate to any station. In one embodiment, first antenna 62 is a bifilar antenna, and signal distribution circuit 64 includes passive RF devices to split a signal with equal power division and 180° phase relationship between the set of radiating conductors 24. Radiating conductors 24 are made of a conductive material and each conductor 24 has a length 74, a width 26 (shown in FIG. 4), an open end 28, a shorted end 29 and a feed end 30. In one embodiment, radiating conductors 24 are made from conductive material printed on a dielectric microstrip substrate 60. In another embodiment, the conductive material is simply attached to the dielectric microstrip substrate 60. The substrate 60 upon which the conductive material is attached has a dielectric constant of more than 1, and on the side of the substrate 60 opposite radiating conductors 24 there is a ground plate 40 (shown in FIG. 4) which is wider than that of the conductive material.

Open ends 28 are electrically and mechanically "open" as it is not connected to any other component in antenna 62. Shorted ends 29 are electrically shorted to ground plate 40. Feed ends 30 are opposite open ends 28, a short distance from shorted ends 29, on radiating conductors 24, have feed points 42 and end with feed strips 44. Feed strips 44 are used to tune antenna 62 to the requisite frequency by adjusting the resistance of radiating conductors 24. Radiating conductors 24 connect to signal distribution circuit 64 through feed points 42.

Figure 2:
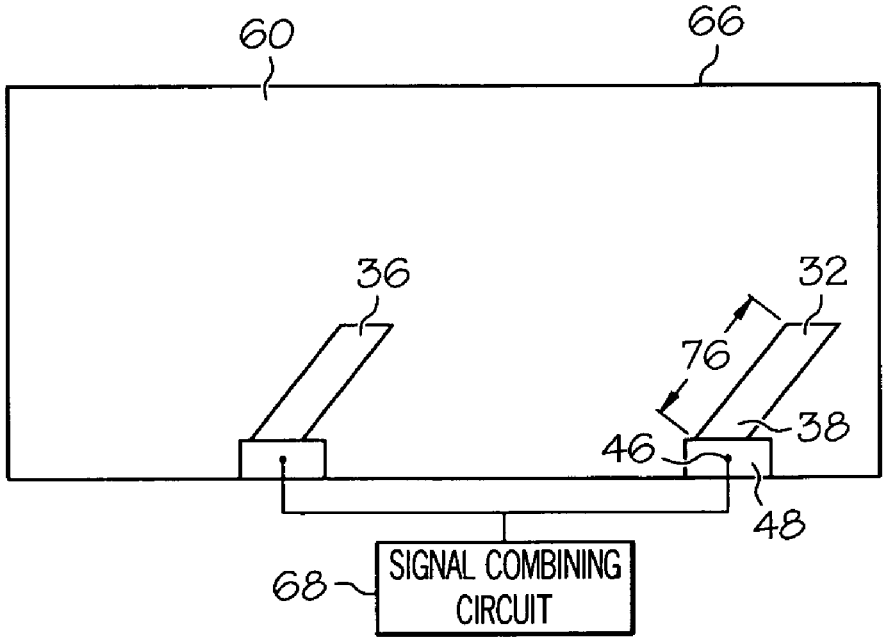
FIG. 2 is a planar representation of a second antenna in an antenna system in accordance with a preferred embodiment of the present invention.

FIG. 2 shows a planar representation of a second antenna 66 in antenna system 20 (shown in FIG. 3). Second antenna 66 includes a set of radiating conductors 32, and a signal combining circuit 68. Signal combining circuit 68 can include an input amp, filter network, and/or any other circuitry (not shown) necessary to ensure that the signal second antenna 66 receives is properly received. In one embodiment, second antenna 66 is a bifilar antenna, and signal combining circuit 68 includes passive RF devices to combine the signals from radiating conductors 32 with equal power weighting and 180° phase relationship. Radiating conductors 32 are made of a conductive material and each conductor 32 has a length 76, a width 34 (shown in FIG. 4), an open end 36 and a feed end 38. Feed ends 38 are closest the edge of antenna 66, have feed points 46 and end in feed strips 48. Feed strips 48 are used to tune antenna 66 to the requisite frequency by adjusting the resistance of radiating conductors 24. Radiating conductors 24 connect to signal combining circuit 68 through feed points 46.

FIG. 3 shows a planar representation of antenna system 20. First antenna 62 and second antenna 66 are integrated into a single antenna system 20. This is done by connecting signal distribution circuit 64 and signal combining circuit 68 to transmit and receive ports of a common transceiver system 70 and power source 72. In one embodiment, power source 72 is a battery. Using a battery rather than a high power, external power source, aids in creating a self-contained antenna system 20. Also, other processing functionality of the antenna system 20, including any processing for modulation and/or demodulation of transmitted/received signals may be integrated into a transceiver system 70.

Radiating conductors 24 and 32 of first antenna 62 and second antenna 66 are also integrated into a single body. This is done by interleaving radiating conductors 24 and 32 such that in between two radiating conductors 24, there will be one radiating conductor 32, and between two radiating conductors 32 there will be one radiating conductor 24. Length 74 of radiating conductors 24 is different from length 76 of radiating conductors 32. Radiating conductors 24 and 32 form an acute angle with feed strips 44 and 48. When the planar representation in FIG. 3 is wrapped upon itself, or around a three-dimensional shell, into a helical structure, radiating conductors 24 and 32 wrap around the structure that is created. This wrapped antenna system 20 (shown in FIG. 4) is a helical antenna system.

In one embodiment of the invention, both radiating conductors 24 and 32 are made of two conductors each, as shown in FIGS. 1-3. Here, antenna system 20 is a bifilar antenna system. Alternatively, first antenna 62 and second antenna 66, may each have four radiating conductors 24 and 32 each, classifying antenna system 20 as a quadrifilar antenna system. Similarly, antenna system 20 is categorized as a multi-filar antenna system when first antenna 62 and second antenna 66 have a plurality of radiating conductors 24 and 32.

Figure 4:
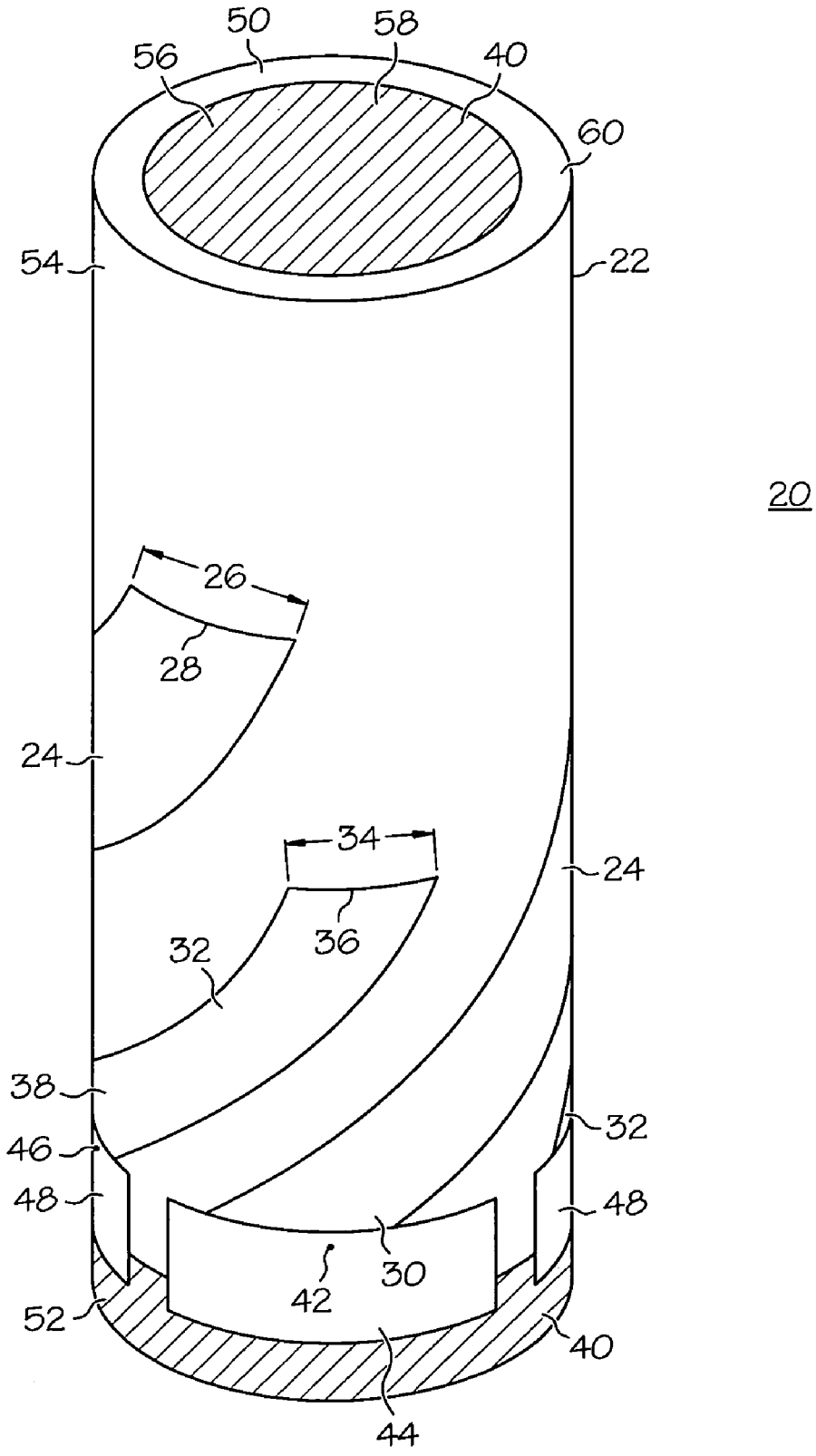
FIG. 4 shows a perspective view of an antenna system in accordance with a preferred embodiment of the present invention.

FIG. 4 shows a perspective view of antenna system 20. Antenna system 20 includes a shell 22, first antenna 62 (shown in FIG. 1) and second antenna 66 (shown in FIG. 2), ground plate 40, power source 72 (shown in FIG. 3), and transceiver system 70 (shown in FIG. 3). Shell 22 is configured to move in a direction 88 (shown in FIGS. 6 and 7). Relative to the direction of movement 88, shell 22 has a front end 50, and a back end 52. Shell 22 also has an exterior surface 54 and an interior surface 56 that surrounds an interior cavity 58. Between exterior surface 54 and interior surface 56 is a solid dielectric material 60. In one embodiment, solid dielectric material 60 is a dielectric microstrip substrate upon which radiating conductors 24 and 32 can be attached. In one embodiment, solid dielectric material 60 of shell 22 can be any solid material whose dielectric constant is greater than 1, such as Teflon.

Ground plate 40 substantially covers interior surface 56 of shell 22, extends around back end 52 of shell 22 to exterior surface 54 and comes in contact with feed strips 44 and 48, thus forming shorted ends 29. Ground plate 40 is the ground plane against which radiating conductors 24 and 32 operate in order to form microstrip patch antenna elements that transmit and receive electromagnetic energy.

Interior cavity 58 can be used as storage if needed. In the event that electrical components, such as signal distribution circuit 64, signal combining circuit 68, power source 72 and transceiver system 70, are stored within interior cavity 58, ground plate 40 also acts to shield the components in interior cavity 58 from electromagnetic radiation emitting from and/or received by radiating conductors 24 and 32. Placing ground plate 40 inside shell 22, rather than external to system 20, aids in antenna system 20 being a self-contained, compact system, not only by reducing the number of external components to system 20, but also by enabling system 20 to carry all requisite electrical components within itself.

Figure 5:
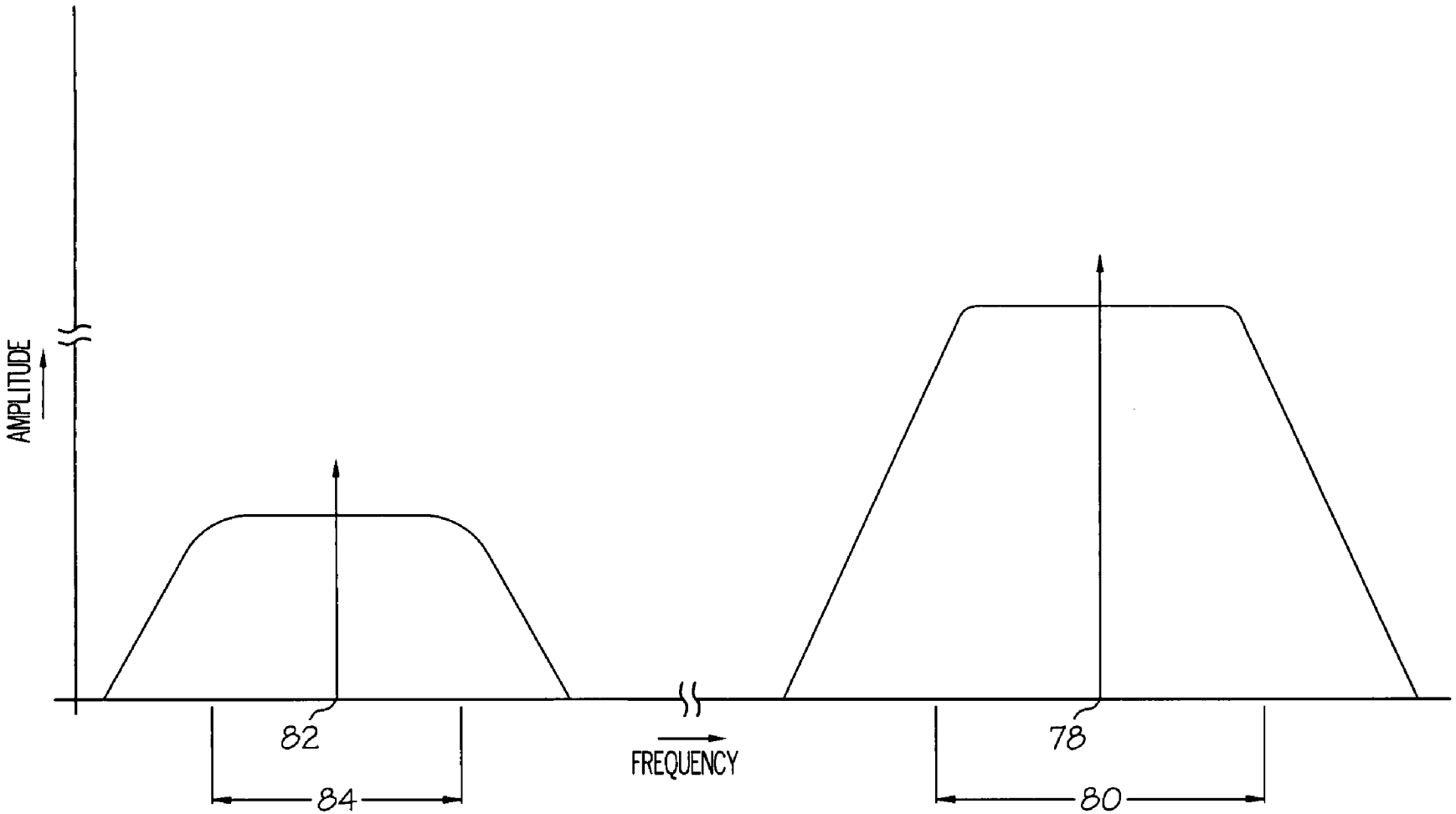
FIG. 5 shows a graph of transmission and reception frequency response of an antenna system in accordance with an a preferred embodiment of the present invention.

FIG. 5 shows a graph plotting frequency bands for antenna system 20. First antenna 62 is tuned to transmit signals at a first frequency 78, having bandwidth 80, and second antenna 66 is tuned to receive signals at a second frequency 82, having bandwidth 84. Tuning antennas 62 and 66 is a two-part process, involving both reactance and resistance. Reactance is primarily affected by the length of radiating conductors 24 and 32. Resistance is primarily affected by the location of feed points 42 and 46 relative to radiating conductors 24 and 32, and the dimensions of feed strips 48 and 64.

Length 74 is nominally an odd integer multiple of one quarter wavelength of the resonant transmission frequency. Length 76 is nominally an odd integer multiple of one quarter wavelength of the resonant reception frequency. Generally, the second stage of tuning, tuning the resistance, is done by moving feed points 42 and 46 until the desired resonant frequency is obtained. In one embodiment of the invention, the dimensions of feed strips 44 and 48 can be used to tune first antenna's 62 and second antenna's 66 resistances, instead of moving feed points 42 and 46.

First frequency 78 and second frequency 82 are desirably spectrally isolated, have narrow bandwidths 80 and 84, and have a large frequency range between them. This spectral isolation of frequencies 78 and 82 reduces interference between signals transmitted by first antenna 62 and received by second antenna 66. In another embodiment, similar isolation can be achieved between transmitting and receiving signals in more proximate frequencies by using filters. Bandwidths 80 and 84 are related to the spacing between radiating conductors 24 and 32 and ground plate 40, and to the dimensions of radiating conductors 24 and 32. As the spacing between radiating conductors 24 and 32 and ground plate 40 is decreased, bandwidths 80 and 84 become more narrow. As radiating conductors 24 and 32 become thinner, bandwidths 80 and 84 become more narrow.

In one embodiment of the present invention, first antenna 62 and second antenna 66 can be tuned independent of one another. First antenna 62 and second antenna 66 are narrowband antennas with a large frequency spread between the resonant frequencies. Also, radiating conductors 24 and 32 are isolated by virtue of their physical location. In one embodiment, first antenna 62 and second antenna 66 are both bifilar antennas, and radiating conductors 24, which are weighted with 180° phase relation, forms nulls along radiating conductors 32. Similarly, in the embodiment where first and second antennas 62 and 64 are both bifilar antennas, radiating conductors 24 are located in nulls formed by radiating conductors 32. This physical isolation of radiating conductors 24 and 32, along with the spectral isolation of transmission and reception signals aids in the ease of tuning antenna system 20 as well as assuring that transmit and receive functions do not interfere.

Figure 6:
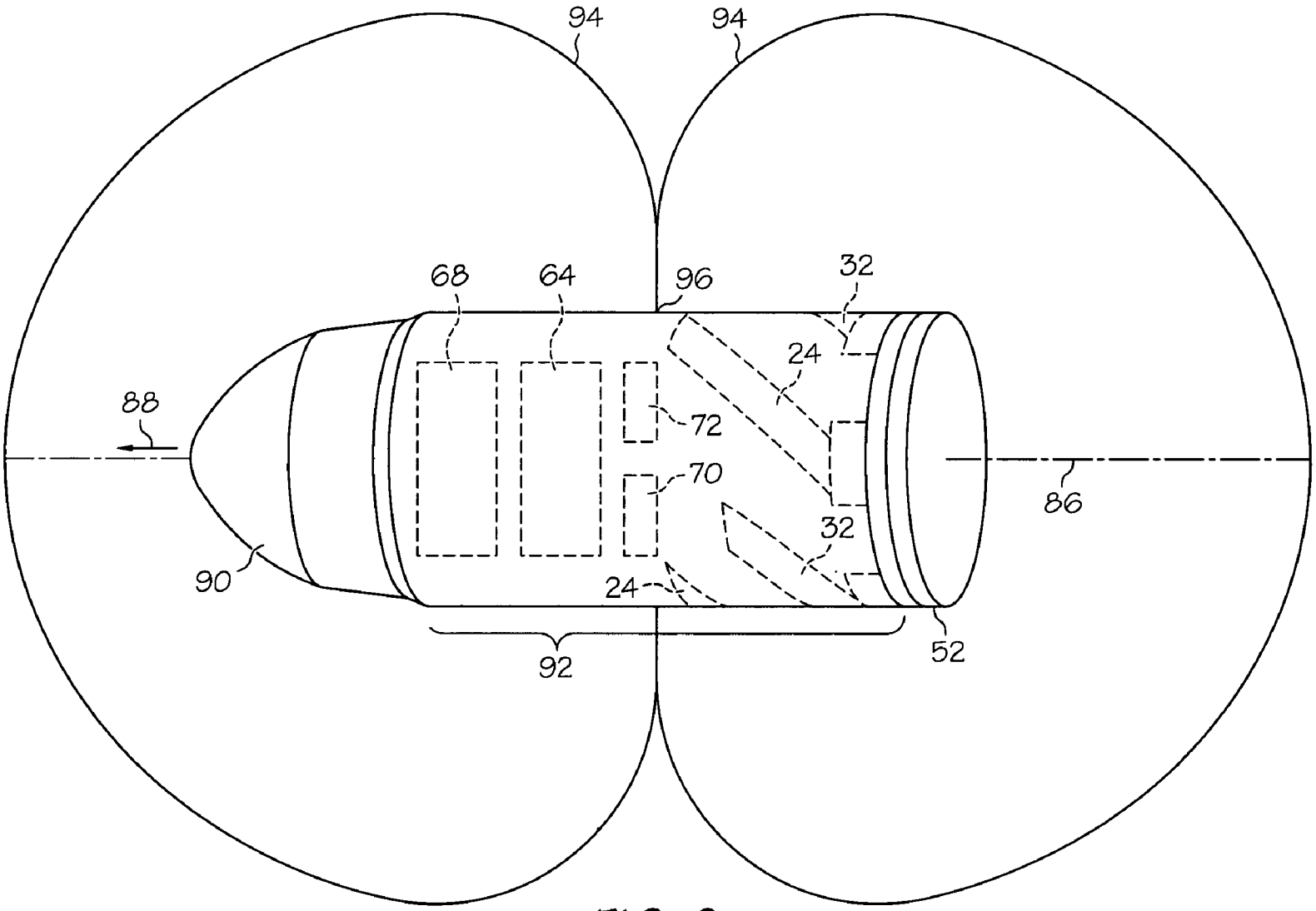
FIG. 6 shows a side view of an antenna system depicting signal transmission patterns in accordance with a preferred embodiment of the present invention.

FIG. 6 shows a side view of antenna system 20 depicting signal transmission patterns. Antenna system 20 has a longitudinal center axis 86. Center axis 86 is also referred to as an axis of motion because antenna system 20 moves in the air along a direction 88 defined by center axis 86. First antenna 62 is configured to sustain communication with a receive station while flying through the air at speeds in excess of 190 mph.

A cone 90 is attached to front end 50 of shell 22. Cone 90 is designed to improve the aerodynamic profile of antenna system 20 as it flees, and thus cone 90 leads the antenna in its direction 88 of movement. Because radiating conductors 24 and 32 are wrapped around shell 22, and shell 22, attached to cone 90, is part of the hull of a flying object, antenna system 20, in one embodiment, is called a conformal antenna system 20. Conformal antenna system 20 is a self-contained system, as requisite circuit components are held within interior cavity 58 of shell 22.

Signal distribution circuit 64, signal combining circuit 68, power box 72, and transceiver system 70 are held within interior cavity 58 of shell 22. Ground plate 40 (shown in FIG. 4) provides shielding for signal distribution circuit 64 and signal combining circuit 68 from potential interference due to radiating conductors 24 and 32.

Due to the multi-filar nature of conformal antenna system 92, the transmit signal pattern 94 varies based upon how many radiating conductors 24 exist in first antenna 62. In one embodiment of conformal antenna system 20, first antenna 62 is a bi-filar helical antenna, having a transmit signal pattern 94 such that the pattern is substantially omni-directional, but having a null 96 along an axis that is perpendicular to the center axis 86. The polar angle of the null axis depends on the location, pitch and dimensions of radiating conductors 24. Energy from null 96 is distributed to the remaining transmit signal pattern 94. This additional energy that is diverted from null 96 is focused such that the transmitting signals in both the direction of movement 88 and opposite direction of movement 88, along axis of movement 86 are stronger. Thus, first antenna 62 transmits signals having a greater gain along axis of motion 86 than transverse to axis of motion 86. Therefore, signal transmission pattern 94 favors the direction of greater gain.

The directionality of signal transmission pattern 98 is related to the number of radiating conductors 24 that first antenna 62 has. In one embodiment first antenna 62 is a quadrifilar antenna, and each radiating conductor 24 is driven with 90° phase progression with respect to the other radiating conductors 24. Therefore, one conductor 24 will be the phase reference, a second 24 will be 90° out of phase with the reference signal, a third 24 will be 180° out of phase, and a fourth 24 will be 270° out of phase. To transmit in the opposite direction, the phase may be changed as follows: the first conductor 24 will once again be the phase reference, the second 24 will be −90°, or 270° out of phase with the reference, the third 24 will be 180° out of phase, and the fourth 24 will be −270°, or 90° out of phase.

Figure 7:
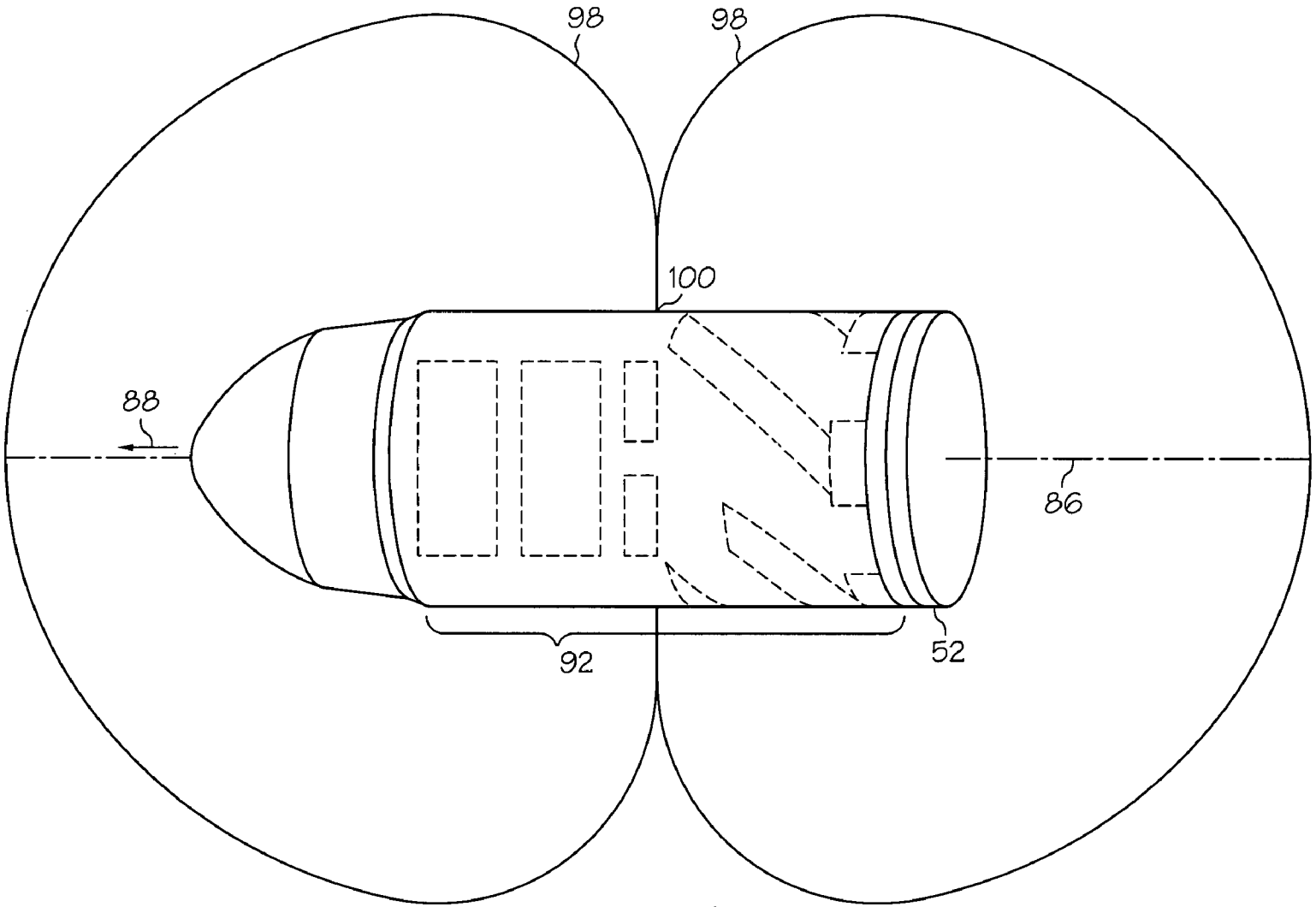
FIG. 7 shows a side view of an antenna system depicting signal reception patterns in accordance with a preferred embodiment of the present invention.

FIG. 7 shows a side view of antenna system 20 depicting signal reception patterns. Similar to transmission pattern 94, the reception signal pattern 98 varies based upon how many radiating conductors 32 exist in second antenna 66. In one embodiment of conformal antenna system 20, second antenna 66 is a bifilar helical antenna, with a receive signal pattern 98 such that the pattern is substantially similar to that of transmit signal pattern 94 described for first antenna 62. Both transmit and receive signal patterns favor transmission and/or reception in the forward and aft directions of the flying object. This combination is suitable for communication nodes collocated in the same direction from the flying object, such as a direct communication link to a single radio. This combination is also suitable for use when receivers and transmitters are in opposite directions, such as a receiving node in the aft direction and a transmitting node in the forward direction. This would be the case if the antennas were being used in a repeater system. In another embodiment, second antenna 66 is a quadrifilar helix, with a receive signal pattern 98 substantially similar to that of transmit signal pattern 94 when the four radiating conductors 32 are phased with the same relative sequence. This makes an antenna system suitable for communication nodes collocated in the same direction. On the other hand, when four radiating conductors 32 are phased with the opposite phase sequence relative to radiating conductors 24, receive signal pattern 98 will have a maximum reception in a direction opposite of transmit signal pattern 94. In this case, conformal antenna system 20 is suitable for use in a repeater system with higher transmission and reception gain than that of the bifilar embodiment of the antenna system.

In summary, the present invention teaches a dual-band multi-filar helical antenna. Unlike a blade antenna, antenna system 20 lies on the exterior surface 54 of a shell 22. Shell 22 can be attached to, and towed by a flying object. Antenna system 20 can also be a conformal antenna system, with shell 22 a part of the flying object, comprising the hull of the flying object. Therefore, antenna system 20 is not a device that protrudes from the surface of the object and is low profile. Also, because radiating conductors 24 and 32 conform to shell 22, there is no additional drag.

First antenna 62 transmits at a first frequency 78 and second antenna 66 receives at a second frequency 82. As the bandwidths 80 and 84 of transmitting 78 and receiving 82 frequencies are narrow and frequencies 78 and 82 are spaced far enough apart, antenna system 20 is able to transmit and receive signals simultaneously with minimal signal degradation.

Also, due to the helical nature of antenna system 20, radiating conductors 24 and 32 are aligned along the body of shell 22. Because shell 22 is attached to a flying object either by front end 50 or back end 52, antenna system is able to effectively communicate with ground or air stations both in the forward and aft directions.

Shell 22 is not solid, but rather has an interior surface 56 and an interior cavity 58. This interior cavity 58 is large enough to house signal distribution circuit 64, signal combining circuit 68 and other circuitry used by antenna system 20 to communicate with other devices or stations. To reduce the potential for interference from first antenna 62 and second antenna 66, ground plate 40 substantially covers interior surface 56, thus effectively isolating signal distribution circuit 64 and signal combining circuit 68 from the potential interference from radiating conductors 24 and 32.

The process of tuning the resistance has been simplified so that the feed points of the antenna do not have to be shifted from location to location until radiating conductors 24 and 32 are tuned to the appropriate frequencies. Rather, the system can be tuned by adjusting the lengths and widths of feed strips 44 and 48 to adjust the resistance of conductors 24 and 32. Furthermore, first antenna 62 can be tuned independently of second antenna 66.

Although the preferred embodiments of the invention have been illustrated and described in detail, it will be readily apparent to those skilled in the art that various modifications may be made therein without departing from the spirit of the invention or from the scope of the appended claims.

What is claimed is:

1. An antenna system comprising:

a shell having an exterior surface and an interior surface;

a first antenna having a first radiating conductor wrapped around said exterior surface, tuned to a first frequency and having a transmit signal pattern;

a second antenna having a second radiating conductor wrapped around said exterior surface, tuned to a second frequency and having a receive signal pattern;

a ground plate substantially covering said interior surface of said shell, said ground plate being configured to be a ground plane against which said first and second radiating conductors operate in order to form microstrip patch antenna elements;

a signal distribution circuit connected to said first antenna; and a signal combining circuit connected to said second antenna;

wherein said shell is configured to move in a direction substantially coincident with an axis of said antenna system and one of said transmit signal pattern and said receive signal pattern favors said direction.

2. An antenna system comprising:

a shell having an exterior surface and an interior surface;

a first antenna having a first radiating conductor wrapped around said exterior surface and tuned to a first frequency;

a second antenna having a second radiating conductor wrapped around said exterior surface and tuned to a second frequency;

a ground plate substantially covering said interior surface of said shell, said ground plate being configured to be a ground plane against which said first and second radiating conductors operate in order to form microstrip patch antenna elements;

a signal distribution circuit connected to said first antenna; and a signal combining circuit connected to said second antenna;

wherein said first antenna , said second antenna , said signal distribution circuit and said signal combining circuit are mutually configured such that transmission and reception take place simultaneously.

3. The antenna system of claim 2 wherein:

said shell is configured to move along an axis of motion; and said first antenna and said second antenna are configured to have a greater gain along said axis of motion than transverse to said axis of motion.

4. An antenna system comprising:

a shell having an exterior surface and an interior surface;

a first antenna having a first radiating conductor wrapped around said exterior surface and tuned to a first frequency;

a second antenna having a second radiating conductor wrapped around said exterior surface and tuned to a second frequency; and a ground plate substantially covering said interior surface of said shell, said ground plate being configured to be a ground plane against which said first and second radiating conductors operate in order to form microstrip patch antenna elements;

wherein said shell has a front end and is configured to move along an axis of motion; and said antenna system further comprises a cone joined to said front end of said shell and aligned with said axis of motion.

5. An antenna system comprising:

a shell having an interior surface, an exterior surface and an interior cavity;

a first antenna having a first radiating conductor wrapped around said exterior surface;

a second antenna having a second radiating conductor wrapped around said exterior surface;

a ground plate substantially covering said interior surface of said shell, said ground plate being configured to be a ground plane against which said first and second radiating conductors operate in order to form microstrip patch antenna elements;

a signal distribution circuit held within said interior cavity and connected to said first antenna; and a signal combining circuit held within said interior cavity and connected to said second antenna.

6. An antenna system comprising:

a shell having an interior surface and an exterior surface;

a first multi-filar antenna having a plurality of helical radiating conductors wrapped around said exterior surface and tuned to a first frequency;

a second multi-filar antenna having a plurality of helical radiating conductors wrapped around said exterior surface and tuned to a second frequency;

a ground plate substantially covering said interior surface, said ground plate being configured to be a ground plane against which said radiating conductors of said first and second multi-filar antennas operate in order to form microstrip patch antenna elements;

a signal distribution circuit held within said interior cavity and connected to said first antenna; and a signal combining circuit held within said interior cavity and connected to said second antenna;

wherein said plurality of helical radiating conductors of said first multi-filar antenna are interleaved between said plurality of helical radiating conductors of said second multi-filar antenna.

* * * * *